US009298136B2

(12) United States Patent
Torimoto

(10) Patent No.: US 9,298,136 B2
(45) Date of Patent: Mar. 29, 2016

(54) AGITATING MECHANISM, TONER CONTAINER, AND IMAGE FORMING APPARATUS

(71) Applicant: KYOCERA Document Solutions Inc., Osaka-shi, Osaka (JP)

(72) Inventor: Masaru Torimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/231,529

(22) Filed: Mar. 31, 2014

(65) Prior Publication Data

US 2015/0063878 A1 Mar. 5, 2015

(30) Foreign Application Priority Data

Aug. 27, 2013 (JP) ..... 2013-175417

(51) Int. Cl.
*G03G 15/08* (2006.01)

(52) U.S. Cl.
CPC ..... *G03G 15/0889* (2013.01); *G03G 15/0865* (2013.01); *G03G 15/0887* (2013.01); *G03G 15/0891* (2013.01); *G03G 2215/0802* (2013.01); *G03G 2215/085* (2013.01); *G03G 2215/0827* (2013.01)

(58) Field of Classification Search
CPC ..... G03G 15/0887; G03G 15/0889; G03G 15/0891; G03G 2215/0827; G03G 2215/085; G03G 15/0865; G03G 2215/0802
See application file for complete search history.

(56) References Cited

U.S. PATENT DOCUMENTS

| | | | | |
|---|---|---|---|---|
| 5,870,652 | A * | 2/1999 | Kanamori et al. | 399/106 |
| 6,229,976 | B1 * | 5/2001 | Kimura | G03G 15/0872 399/263 |
| 6,438,345 | B1 | 8/2002 | Ban et al. | |
| 6,526,245 | B1 * | 2/2003 | Yamashita | G03G 15/0822 399/254 |
| 7,532,843 | B2 * | 5/2009 | Kern | G03G 15/0875 399/254 |
| 8,200,128 | B2 * | 6/2012 | Oda | G03G 15/0898 399/263 |

(Continued)

FOREIGN PATENT DOCUMENTS

| | | | |
|---|---|---|---|
| EP | 1041454 | A1 | 10/2000 |
| JP | S61190554 | U | 11/1986 |

(Continued)

OTHER PUBLICATIONS

European Patent Office, Extended European Search Report Issued in European Patent Application No. 14161876.9, Mar. 3, 2015, Germany, 7 pages.

*Primary Examiner* — Ryan Walsh
(74) *Attorney, Agent, or Firm* — Alleman Hall McCoy Russell & Tuttle LLP

(57) ABSTRACT

An agitating mechanism according to one aspect of the present disclosure is disposed in a toner container in which toner is stored. The agitating mechanism includes a rotation shaft member. The rotation shaft member is configured to support an agitating member that agitates the toner. The rotation shaft member is provided, together with the agitating member, in the toner container so as to be rotatable. The rotation shaft member has a through hole that passes through the rotation shaft member in a first direction orthogonal to a rotation axis direction.

11 Claims, 16 Drawing Sheets

(56) References Cited

U.S. PATENT DOCUMENTS

| | | | | |
|---|---|---|---|---|
| 2002/0122676 | A1* | 9/2002 | Yamada | G03G 15/0868 399/263 |
| 2006/0051135 | A1 | 3/2006 | Sato et al. | |
| 2007/0196135 | A1* | 8/2007 | Fukuta | 399/254 |
| 2009/0067888 | A1 | 3/2009 | Murata et al. | |
| 2009/0208253 | A1 | 8/2009 | Ohgoshi et al. | |
| 2010/0189469 | A1* | 7/2010 | Nozawa et al. | 399/254 |
| 2014/0086640 | A1* | 3/2014 | Okabe | G03G 15/0875 399/263 |

FOREIGN PATENT DOCUMENTS

| | | | |
|---|---|---|---|
| JP | H04344668 | A | 12/1992 |
| JP | 2000347493 | A | 12/2000 |
| JP | 2002236410 | A | 8/2002 |
| JP | 2003013987 | A | 1/2003 |
| JP | 2003057928 | A | 2/2003 |
| JP | 2004133479 | A | 4/2004 |
| JP | 2007316447 | A | 12/2007 |
| JP | 2010113262 | A | 5/2010 |
| JP | 3164687 | U | 12/2010 |

* cited by examiner

AGITATING MECHANISM, TONER CONTAINER, AND IMAGE FORMING APPARATUS

INCORPORATION BY REFERENCE

This application is based upon and claims the benefit of priority from the corresponding Japanese Patent Application No. 2013-175417 filed on Aug. 27, 2013, the entire contents of which are incorporated herein by reference.

BACKGROUND

The present disclosure relates to agitating mechanisms that agitate toner in toner containers, toner containers including the agitating mechanisms, and image forming apparatuses including the toner containers.

Developing devices are mounted to image forming apparatuses, such as copy machines and printers, which form images on print sheets by electrophotography. In the developing device, developer including toner is stored. The developing device develops an electrostatic latent image formed on an image carrier such as a photosensitive drum, by using toner included in the developer. Toner in the developing device is reduced by the development being performed. Therefore, the image forming apparatus includes a toner container in which toner is stored, and additionally supplies toner from the toner container to the developing device. Further, the toner container is detachably mounted to the image forming apparatus. When the toner in the toner container is all consumed, the toner container is exchanged for a new toner container that is filled with toner.

In this type of toner container, an agitating mechanism that agitates toner stored in the toner container is provided. The agitating mechanism includes a rotation shaft and an agitating member. The rotation shaft is supported, in the toner container, so as to be rotatable. The agitating member is formed by a resin film or the like so as to have a paddle-like shape. The agitating member is fixed to the rotation shaft. By the rotation shaft being rotated, the agitating member also rotates in the same direction as the rotation shaft. Thus, the toner in the toner container is agitated.

As the rotation shaft used for the agitating mechanism, a shaft that has a groove in which a direction orthogonal to a rotation axis direction is defined as a depth direction, has been known. By the groove being formed in the rotation shaft, a weight of the rotation shaft or a rotational load thereon can be reduced. When toner enters the groove, the toner is trapped in a space enclosed and defined by inner surfaces and a bottom surface of the groove. In this case, the toner in the groove is not sufficiently agitated, and is more likely to be deteriorated as compared to toner in other portions. Further, in the groove, the toner that has entered the groove may be agglomerated, thereby generating lumps of toner. By the lumps of toner being discharged from the groove, rotation of the agitating member becomes unstable due to the lumps of toner, and toner is not sufficiently agitated in the toner container. Further, the lumps of toner may hit against the agitating member, thereby generating an abnormal sound.

SUMMARY

An agitating mechanism according to one aspect of the present disclosure is disposed in a toner container in which toner is stored. The agitating mechanism includes a rotation shaft member. The rotation shaft member is configured to support an agitating member that agitates the toner. The rotation shaft member is provided, together with the agitating member, in the toner container so as to be rotatable. The rotation shaft member has a through hole that passes through the rotation shaft member in a first direction orthogonal to a rotation axis direction.

A toner container according to another aspect of the present disclosure includes: a container body in which toner is stored; and an agitating mechanism disposed in the container body. The agitating mechanism includes a rotation shaft member that is configured to support an agitating member which agitates the toner, that is provided, together with the agitating member, in the container body so as to be rotatable, and that has a through hole which passes through the rotation shaft member in a first direction orthogonal to a rotation axis direction.

An image forming apparatus according to still another aspect of the present disclosure includes: a toner container having a container body in which toner is stored; an agitating mechanism disposed in the container body; and an image forming portion configured to form an image on a recording medium by using toner supplied from the toner container. The agitating mechanism includes a rotation shaft member that is configured to support an agitating member which agitates the toner, that is provided, together with the agitating member, in the container body so as to be rotatable, and that has a through hole which passes through the rotation shaft member in a first direction orthogonal to a rotation axis direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
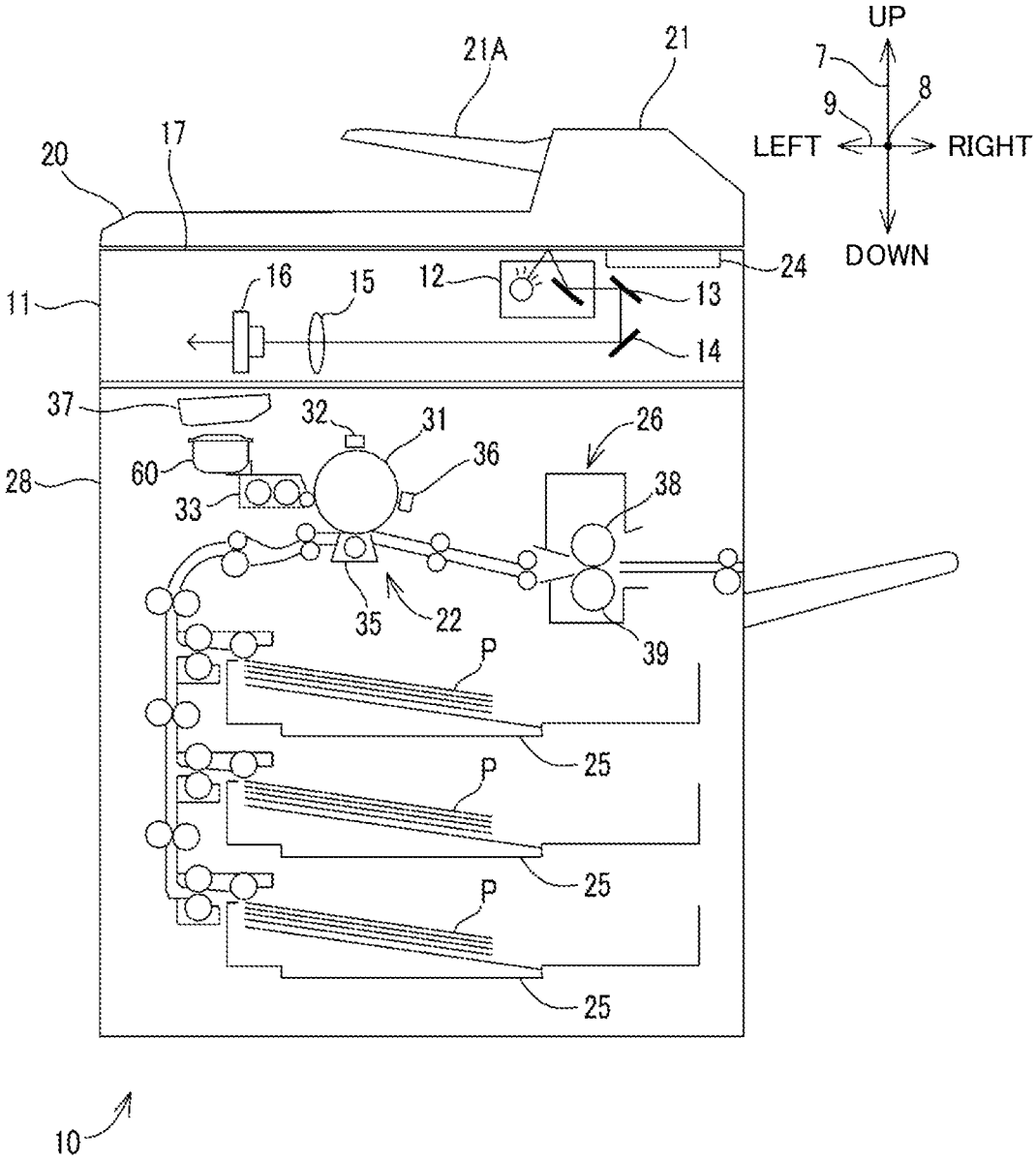
FIG. 1 illustrates a structure of an image forming apparatus according to an embodiment of the present disclosure.

Hereinafter, a toner container 60 and an image forming apparatus 10 according to embodiments of the present disclosure will be described with reference to the drawings. In the below description, an up-down direction 7 is defined based on a state where the image forming apparatus 10 is installed on a flat plane. A front-rear direction 8 is defined based on the near side (front surface side) representing a side on which the toner container 60 is inserted. A right-left direction 9 is defined by the image forming apparatus 10 being viewed from the near side (front surface side).

[Schematic Structure of Image Forming Apparatus 10]

The image forming apparatus 10 is an apparatus that has at least a printing function, and is, for example, a multifunction peripheral. The image forming apparatus 10 prints an image on a print sheet P (recording medium) that is a sheet-like medium, by using developer including toner. The image forming apparatus 10 is not limited to a multifunction peripheral, and may be a single function machine such as a printer, a FAX apparatus, or a copy machine.

Figure 2:
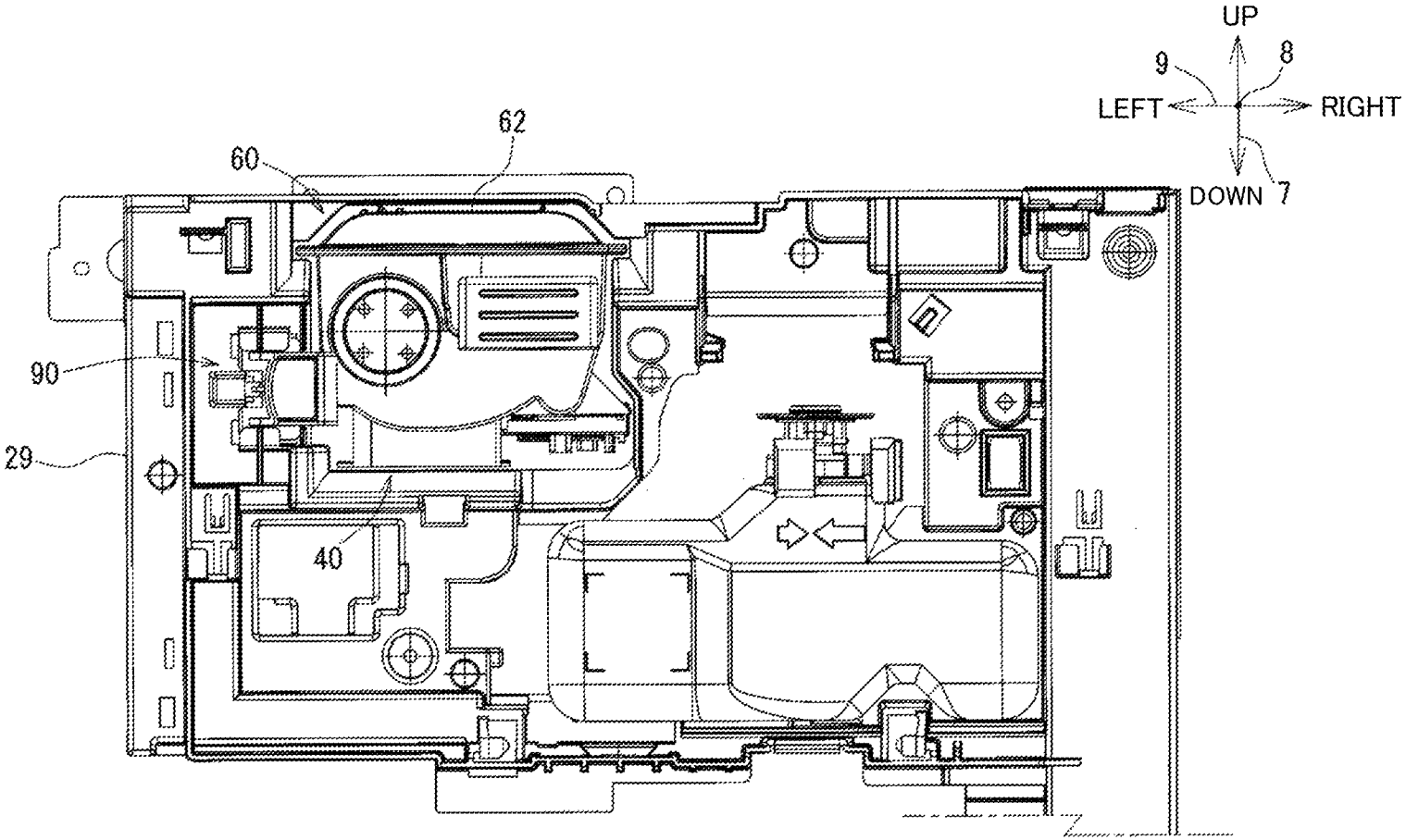
FIG. 2 illustrates a state where a toner container according to an embodiment of the present disclosure is mounted to the image forming apparatus shown in FIG. 1.

As shown in FIGS. 1 and 2, the image forming apparatus 10 mainly includes an image reading portion 11, a document sheet cover 20, an ADF (Automatic Document Feeder) 21, an image forming portion 22, an operation display portion 24, a sheet feed device 25, a fixing device 26, a container mounting portion 40, a locking member 90, the toner container 60, and a control portion (not shown) that comprehensively controls the image forming apparatus 10. These components are mounted to a casing 28 that forms an external frame (not shown), an internal frame 29 (see FIG. 2), and the like of the image forming apparatus 10.

The image reading portion 11 executes an image reading process in which image data is read from a document sheet placed on a contact glass 17. As shown in FIG. 1, the image reading portion 11 includes a reading unit 12, mirrors 13 and 14, an optical lens 15, a CCD 16, and the like. The reading unit 12 includes, for example, a light source such as a LED, and can be moved in a secondary scanning direction (the right-left direction 9 in FIG. 1) by a not-illustrated moving mechanism using a motor such as a stepping motor. When the reading unit 12 is moved in the secondary scanning direction by the motor, scanning in the secondary scanning direction is performed with light applied from the light source toward the contact glass 17 of the image reading portion 11. The light is reflected by a document sheet toward the mirror 13 due to this scanning, and the reflected light is further guided to the optical lens 15 by the mirror 14. The optical lens 15 focuses the incident light on the CCD 16. The CCD 16 outputs, to the control portion, data representing an amount of light that corresponds to an amount of received light. When the control portion obtains data representing an amount of light for the entire region to which the light is applied, the control portion processes the data representing the amount of light, thereby generating image data of the document sheet based on the data representing the amount of light. In the present embodiment, an exemplary case where the CCD 16 is used as an imaging device is described. However, instead of the reading mechanism using the CCD 16, a reading mechanism that includes a contact image sensor (CIS) having a focal length shorter than the CCD 16 may be used.

The ADF 21 is mounted in the document sheet cover 20. The ADF 21 sequentially conveys document sheets that are set in a document sheet setting portion 21A, by a plurality of conveying rollers (not shown), and moves the document sheets, through a reading position defined on the contact glass 17, rightward in the secondary scanning direction. When the document sheets are moved by the ADF 21, the reading unit 12 is positioned at a position below the reading position, and an image of the document sheet being moved is read at this position by the reading unit 12.

The image forming portion 22 executes an image forming process in which an image is formed on a print sheet P according to a so-called electrophotography. The image forming portion 22 prints an image on the print sheet P based on image data read by the image reading portion 11, or image data inputted from the outside through a not-illustrated network communication portion. For example, when a printing job is transferred from a personal computer, the image forming portion 22 prints an image on the print sheet P based on image data and printing condition indicated by the printing job. As shown in FIG. 1, the image forming portion 22 includes a photosensitive drum 31, a charging device 32, a developing device 33, a transfer device 35, an electricity removing device 36, an exposure device (LSU: Laser Scanning Unit) 37, and the like.

When the image forming process by the image forming portion 22 is started, the surface of the photosensitive drum 31 is charged to have a uniform potential by the charging device 32. Scanning is performed on the photosensitive drum 31 by the exposure device 37, with laser light corresponding to the image data. Thus, an electrostatic latent image is formed on the photosensitive drum 31. Thereafter, toner is adhered to the electrostatic latent image by developing process of the developing device 33, to form a toner image on the photosensitive drum 31. The toner image is transferred, by the transfer device 35, to a print sheet P conveyed in a conveying path. The print sheet P having the toner image transferred thereto is conveyed to the fixing device 26 disposed downstream (the right side in FIG. 1) of the image forming portion 22 in a direction in which the print sheet P is conveyed.

The fixing device 26 fixes, by heat, the toner image transferred to the print sheet P, onto the same print sheet P. The fixing device 26 includes a heating roller 38 and a pressure roller 39. The pressure roller 39 is urged toward the heating roller 38, by an elastic member such as a spring. Thus, the pressure roller 39 is pressed against the heating roller 38. The heating roller 38 is heated to a high temperature by a heater when the fixing operation is performed. When the print sheet P passes through the fixing device 26, toner of the toner image is heated by the heating roller 38 and fused, and the print sheet P is pressed by the pressure roller 39. Thus, toner is fixed onto the print sheet P by the fixing device 26, and an image is formed on the print sheet P.

[Structure of Container Mounting Portion 40]

Figure 3:
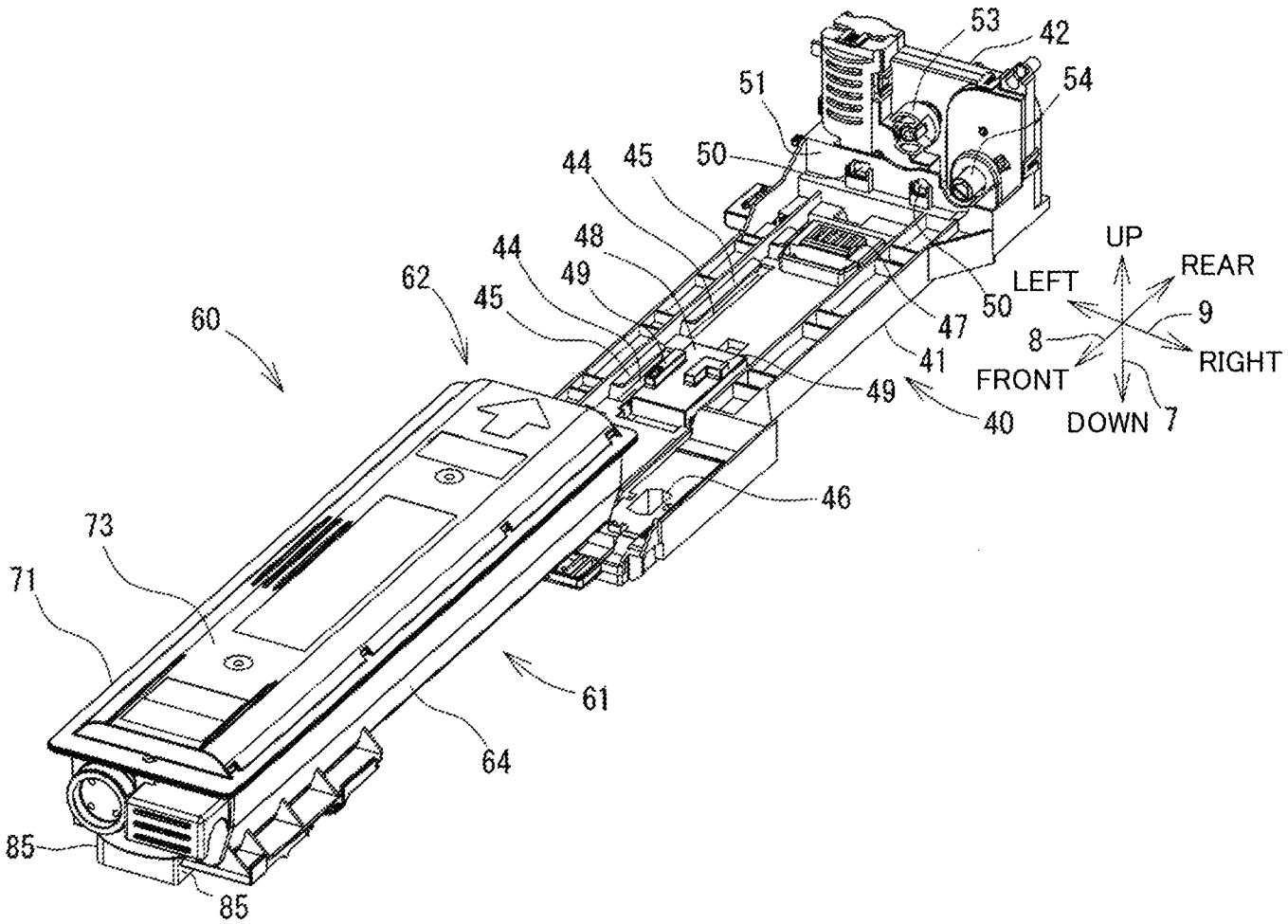
FIG. 3 is a perspective view of a container mounting portion included in the image forming apparatus shown in FIG. 1, and the toner container according to the embodiment of the present disclosure.

As shown in FIG. 2, the container mounting portion 40 is fixed to the internal frame 29 of the casing 28. By the container mounting portion 40, the toner container 60 is detachably mounted. Namely, the toner container 60 is detachably mounted to the image forming apparatus 10 through the container mounting portion 40. The container mounting portion 40 supports the toner container 60 such that the toner container 60 is slidable in the front-rear direction 8 (inserting/detaching direction). As shown in FIG. 3, the container mounting portion 40 includes a support base 41 and a drive transmission portion 42. The support base 41 supports the toner container 60 from a bottom surface 64 side thereof, and is formed in a plate-like shape elongated in the front-rear direction 8. On a top surface of the support base 41, a pair of guide grooves 44 is formed so as to extend in the front-rear direction 8. The paired guide grooves 44 are spaced from each other in the right-left direction 9. By the paired guide grooves 44, the toner container 60 is guided in the front-rear direction 8. Into the paired guide grooves 44, rail-shaped guide portions 85 that are provided on the bottom surface 64 of the toner container 60 as described below, are inserted. Thus, the toner container 60 is supported, by the container mounting portion 40, so as to be slidable in the front-rear direction 8. The guide groove 44 may be formed in a continuous straight line shape along the front-rear direction 8. Alternatively, the guide grooves 44 may be intermittently provided along the front-rear direction 8.

Figure 4:
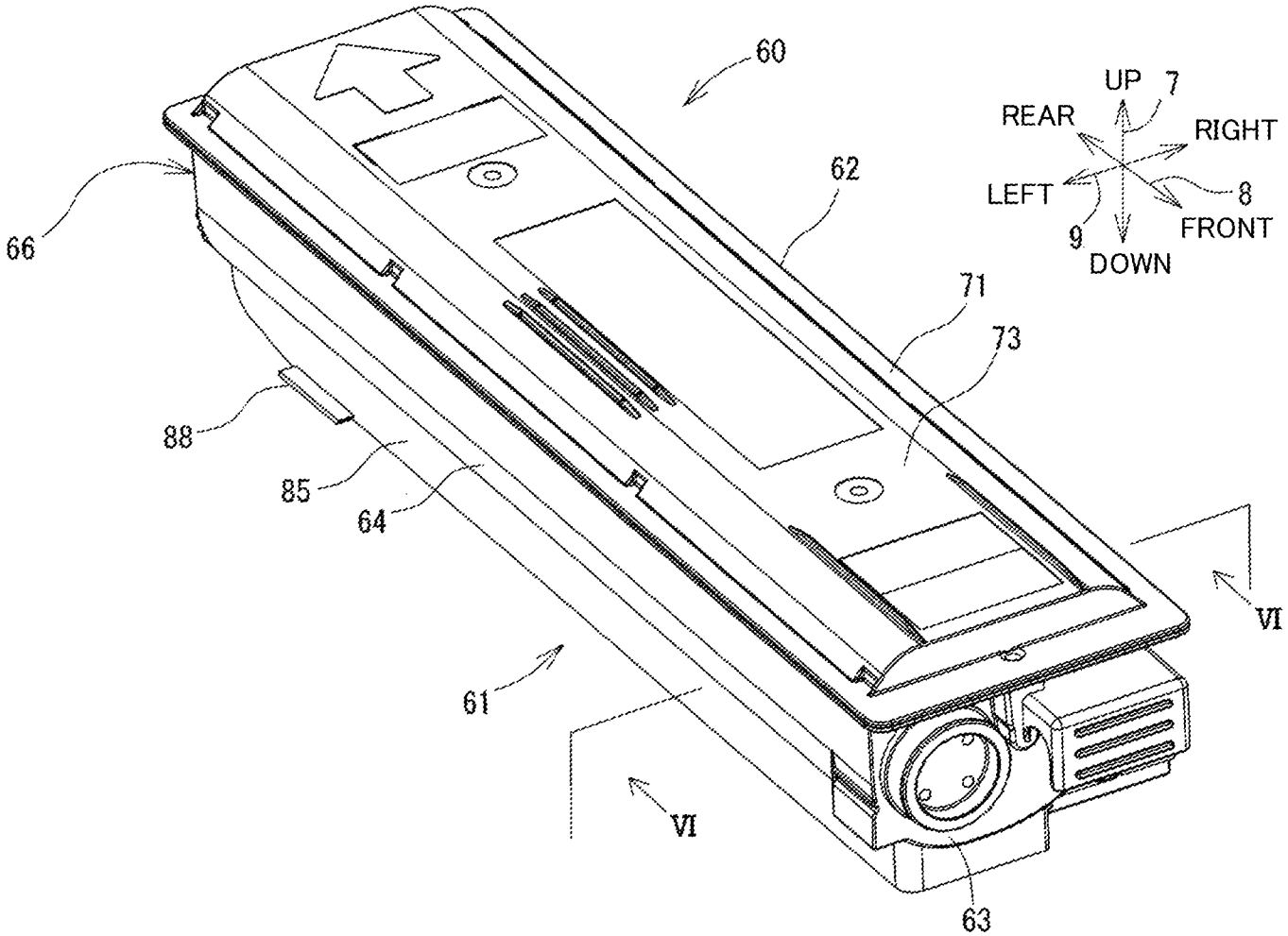
FIG. 4 is a perspective view illustrating a structure of the toner container shown in FIG. 3 as viewed from diagonally above the toner container.

The guide grooves 44 each have an eave-shaped stopper 45 that projects toward the groove center. In FIG. 3, the stopper 45 of the guide groove 44 disposed on the left side projects from the left end portion of the guide groove 44 toward the groove center. On the other hand, in FIG. 3, the stopper 45 of the guide groove 44 (not shown) disposed on the right side projects from the right end portion of the guide groove 44 toward the groove center. These stoppers 45 engage, in the up-down direction 7, with projections 88 (see FIG. 4) which are provided in the guide portions 85 as described below, when the toner container 60 is inserted. Thus, the toner container 60 is prevented from moving in the up-down direction 7.

As shown in FIG. 3, a through hole 46 that passes through the support base 41 in the up-down direction 7 is formed near the front end portion of the support base 41. The through hole 46 is a toner conveying path through which toner supplied through a supply opening 67 (see FIG. 5) of the toner container 60 is conveyed to the developing device 33 when the toner container 60 is mounted to the container mounting portion 40. In the present embodiment, when the toner container 60 is mounted at a mounting position defined in the container mounting portion 40, the supply opening 67 of the toner container 60 is positioned above the through hole 46. Namely, the mounting position is a position at which toner can be supplied to the developing device 33 from a container body 61 of the toner container 60.

On the top surface of the support base 41, a contact terminal 47 that enables electrical connection is disposed. The contact terminal 47 is disposed near the rear end portion of the top surface of the support base 41. The contact terminal 47 electrically contacts with a terminal of a storage portion (not shown) of the toner container 60 when the toner container 60 is mounted at the mounting position of the container mounting portion 40.

Further, on the top surface of the support base 41, an identification portion 48 is provided by which whether or not mounting of the toner container 60 is to be allowed is determined. The identification portion 48 is disposed near the center, in the front-rear direction 8, of the top surface of the support base 41. The identification portion 48 has a projection 49 having a predetermined pattern shape. When the toner container 60 having an identified portion 79 (see FIG. 5) that has a pattern shape corresponding to the projection 49 is inserted, the toner container 60 is allowed to be inserted so as to reach the mounting position. When the toner container 60 having another identified portion 79 that does not correspond to the projection 49, is inserted, insertion of the toner container 60 is prevented by the identification portion 48.

Two positioning holes 50 are formed in the rear end portion of the support base 41. When the toner container 60 is mounted to the container mounting portion 40, the positioning holes 50 are used to position the toner container 60 at the mounting position. The positioning holes 50 are formed on a wall surface 51 that extends upward from the rear end of the top surface of the support base 41. The positioning holes 50 are through holes that extend rearward so as to pass through the wall surface 51. When positioning members 82 (see FIG. 5), as described below, of the toner container 60 are inserted into the positioning holes 50, the toner container 60 is positioned at the mounting position, thereby assuredly mounting the toner container 60 at the mounting position.

As shown in FIG. 3, two joints 53 and 54 are provided in the drive transmission portion 42. To each of the joints 53 and 54, rotation driving force of a motor (not shown) is transmitted. The joint 53 is provided almost at the center of the drive transmission portion 42. When the toner container 60 is mounted to the container mounting portion 40, the joint 53 is connected to a joint 57 (see FIG. 7) of an agitating mechanism 56 (see FIGS. 6 and 7) disposed in the toner container 60. The joint 54 is disposed in the lower right corner portion of the drive transmission portion 42. When the toner container 60 is mounted to the container mounting portion 40, the joint 54 is connected to a joint 59 (see FIG. 5) of a spiral shaft 58 (see FIG. 6) disposed in the toner container 60.

[Structure of Locking Member 90]

FIG. 2 illustrates a state where the toner container 60 is mounted to the container mounting portion 40. FIG. 2 illustrates components, near the container mounting portion 40, which are exposed on the front surface side in a state where a front cover of the image forming apparatus 10 is removed. As shown in FIG. 2, the locking member 90 is mounted to the internal frame 29 of the casing 28. More specifically, the locking member 90 is supported by the internal frame 29 so as to be movable in the right-left direction 9. When the toner container 60 is mounted at the mounting position of the container mounting portion 40, the locking member 90 engages with a projection (not shown) of the toner container 60 to fix the toner container 60 at the mounting position. The locking member 90 is, for example, claw-shaped. In the present embodiment, the locking member 90 is supported so as to be movable between a locking portion (position shown in FIG. 2) at which the locking member 90 is caught by the projection (not shown) to prevent movement of the toner container 60 toward the near side, and an unlocking position to which the locking member 90 is moved leftward from the locking position and at which the toner container 60 can be detached from the container mounting portion 40 toward the near side. The locking member 90 is urged toward the locking position by an elastic member such as a spring. When a user moves the locking member 90 from the locking position to the unlocking position, locking of the toner container 60 by the locking member 90 is cancelled.

[Structure of Toner Container 60]

Hereinafter, a structure of the toner container 60 will be described in detail with reference to FIG. 3 to FIG. 10. In each of FIG. 3 to FIG. 10, based on an orientation (mounted orientation) of the toner container 60 mounted to the casing 28, the vertical direction is defined as the up-down direction 7, a direction in which the toner container 60 is inserted into and detached from the casing 28 is defined as the front-rear direction 8, and the horizontal direction as viewed from the front surface of the toner container 60 in the mounted orientation is defined as the right-left direction 9.

By the toner container 60, toner is supplied to the developing device 33. As shown in FIG. 1, the toner container 60 is disposed on the upper left side of the casing 28. More specifically, the toner container 60 is disposed above and to the left of the developing device 33. The toner container 60 can be mounted to and detached from the container mounting portion 40 of the casing 28. The toner container 60 is supported so as to be slidable in the front-rear direction 8 such that the toner container 60 can be inserted into and detached from the container mounting portion 40.

As shown in FIG. 3, the toner container 60 has a shape elongated in the front-rear direction 8. The toner container 60 includes the container body 61 and a cover 62.

In the container body 61, toner is stored. The container body 61 has a box-like shape elongated in the front-rear direction 8. The container body 61 includes the bottom surface 64 that has almost an arc shape that is curved downward, and an opening 65 (see FIG. 6), having a rectangular shape, at which the top of the container body 61 is widely open. In the container body 61, toner used for developing process by the developing device 33 is stored. The container body 61 is a synthetic resin product that is formed by melted synthetic resin being poured into a mold, and subjected to injection molding. In general, when melted synthetic resin is cooled and hardens, the resin contracts. Therefore, the container body 61 is formed so as to have a uniform thickness in any portion thereof such that generation of a so-called "sink mark" on the surface of the container body 61 due to the contraction is prevented. Namely, an external wall of the container body 61 is formed so as to have a uniform thickness in any portion thereof. The "sink mark" represents deformation, such as recess, depression, or distortion, which occurs in a synthetic resin product due to difference, in contraction, which is caused by non-uniform thickness or the like. As a material of the container body 61, a thermoplastic synthetic resin may be used. Specifically, an ABS resin, a PET (polyethylene terephthalate) resin, or a synthetic resin including an ABS resin and/or a PET resin as a main component, is used as a material of the container body 61.

The cover 62 is formed in a shape corresponding to the opening 65 on the top surface of the container body 61, and is formed in a rectangular shape elongated in the front-rear direction 8. The cover 62 covers the opening 65 of the container body 61. The cover 62 includes an outer edge portion 71 that contacts with the edge of the opening 65, and an inner wall portion 73 that is slightly raised from the outer edge portion 71. The cover 62 is a synthetic resin product formed by injection molding, similarly to the container body 61.

Figure 5:
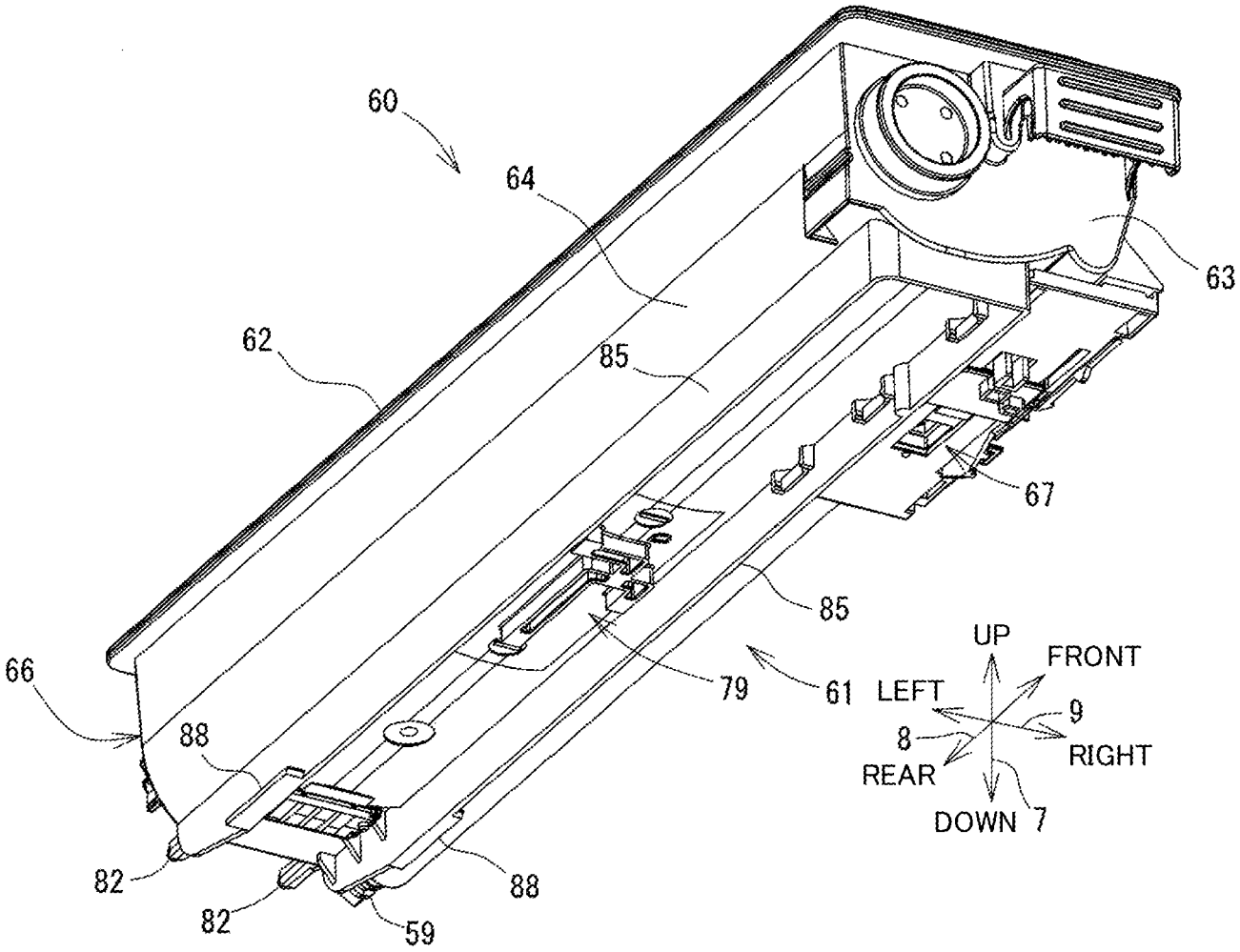
FIG. 5 is a perspective view illustrating a structure of the toner container shown in FIG. 3, as viewed from diagonally below the toner container.

As shown in FIG. 5, the container body 61 includes a pair of the guide portions 85. The guide portions 85 are disposed on the bottom surface 64 of the container body 61. When the toner container 60 is inserted into the container mounting portion 40, the paired guide portions 85 allow the container body 61 to be guided in the mounting direction toward the mounting position. Specifically, the paired guide portions 85 are each formed in a rail-like shape that has a narrow width and extends in the mounting direction (the direction corresponding to the front-rear direction 8). The paired guide portions 85 are disposed on the bottom surface 64 at positions corresponding to the guide grooves 44 (see FIG. 3), respectively. When the guide portions 85 are inserted into the guide grooves 44, and guided along the guide grooves 44, respectively, the container body 61 is guided in the mounting direction. In the present embodiment, each of the guide portions 85 extends to a rear surface 66 on the rear side of the container body 61.

The guide portions 85 each project in a direction perpendicular to the bottom surface 64, and have the projections 88 disposed in the end portions thereof, respectively. One projection 88 is provided in each guide portion 85. The projections 88 project in the right-left direction 9 (orthogonal direction) orthogonal to the side surfaces of the guide portions 85, respectively. In FIG. 5, the projection 88 of the guide portion 85 disposed on the left side, projects leftward from the end portion of the guide portion 85. On the other hand, in FIG. 5, the projection 88 of the guide portion 85 disposed on the right side, projects rightward from the end portion of the guide portion 85. In the present embodiment, the projections 88 are disposed on the rear surface 66 side in the guide portions 85.

When the toner container 60 is inserted into the container mounting portion 40, the guide portions 85 are inserted into the guide grooves 44, respectively. In a state where the guide portions 85 are inserted into the guide grooves 44, a direction in which the guide portions 85 are moved is restricted to a direction along the guide grooves 44. Further, in a state where the guide portions 85 are inserted into the guide grooves 44, the projections 88 of the guide portions 85 engage with the stoppers 45 of the guide grooves 44, to prevent movement of the projections 88 in the up-down direction 7. In other words, when the toner container 60 is moved rearward (in the mounting direction) in the front-rear direction 8 and inserted into the container mounting portion 40, the container body 61 is positioned, by the guide portions 85, so as not to be displaced in the right-left direction 9, and the container body 61 is simultaneously guided rearward along the guide grooves 44 by the guide portions 85. Further, when the toner container 60 is moved rearward (in the mounting direction) in the front-rear direction 8 and inserted into the container mounting portion 40, the container body 61 is positioned, by the projections 88, so as not to be displaced in the up-down direction 7 orthogonal to the bottom surface 64, and the container body 61 is simultaneously guided rearward by the projections 88.

The guide portions 85 provided so as to have such a structure prevent shaking in the right-left direction 9, and also prevent shaking in the up-down direction 7. As a result, handling of the toner container 60 in an inserting operation for mounting the toner container 60, and a drawing operation for detaching the toner container 60 is smoothly performed, and operability for mounting and detaching the toner container 60 can be improved.

Figure 7:
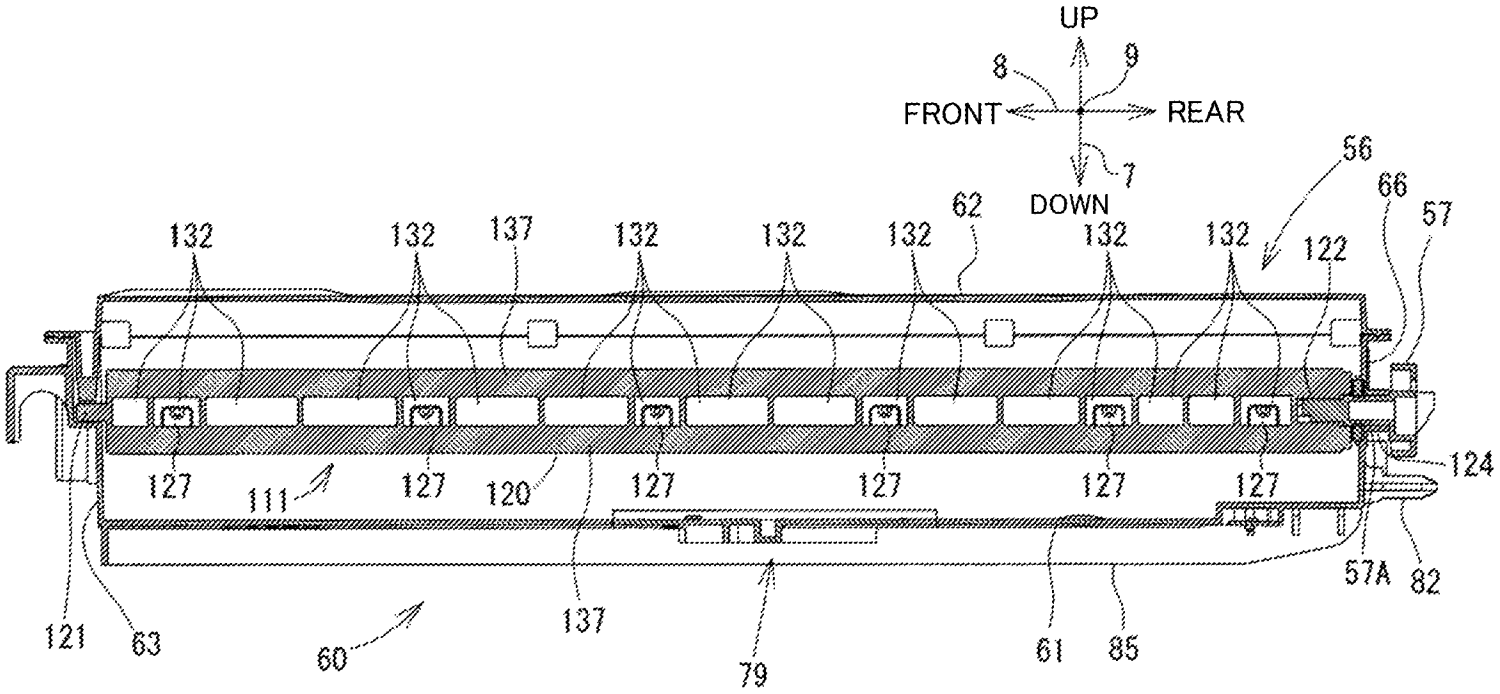
FIG. 7 is a cross-sectional view illustrating a structure of a cross-section taken along a line VII-VII in FIG. 6.

Further, as shown in FIGS. 5 and 7, the two pin-shaped positioning members 82 are disposed on the rear surface 66 of the container body 61. The positioning members 82 project rearward from the rear surface 66. The positioning members 82 are disposed at positions corresponding to the positioning holes 50 of the container mounting portion 40. When the toner container 60 is mounted at the mounting position of the container mounting portion 40, the positioning members 82 are inserted into the positioning holes 50. Thus, the toner container 60 is positioned at the mounting position in the container mounting portion 40, thereby assuredly mounting the toner container 60 at the mounting position.

As described above, the container body 61 is formed by melted synthetic resin in a mold being subjected to injection molding. For the container body 61 that is such a synthetic resin product, a mold by which the bottom surface 64 side portion including a curved portion is formed, and a mold by which the top surface side portion of the container body 61 is formed, are necessary. Further, the projections 88 disposed on the rear surface 66 side project in the right-left direction 9, and the positioning members 82 project in the front-rear direction 8. Therefore, the projections 88 and the positioning members 82 cannot be formed by the above-described two molds only. Namely, a slide core (slide mold) by which a rear end portion including the rear surface 66 of the container body 61 is formed, is necessary. The slide core is slid rearward for demolding. In the present embodiment, since the projections 88 and the positioning members 82 are disposed in the rear side portion of the container body 61, the rear end portion can be formed by injection molding with the use of the slide core.

[Structure of Agitating Mechanism 56]

Figure 6:
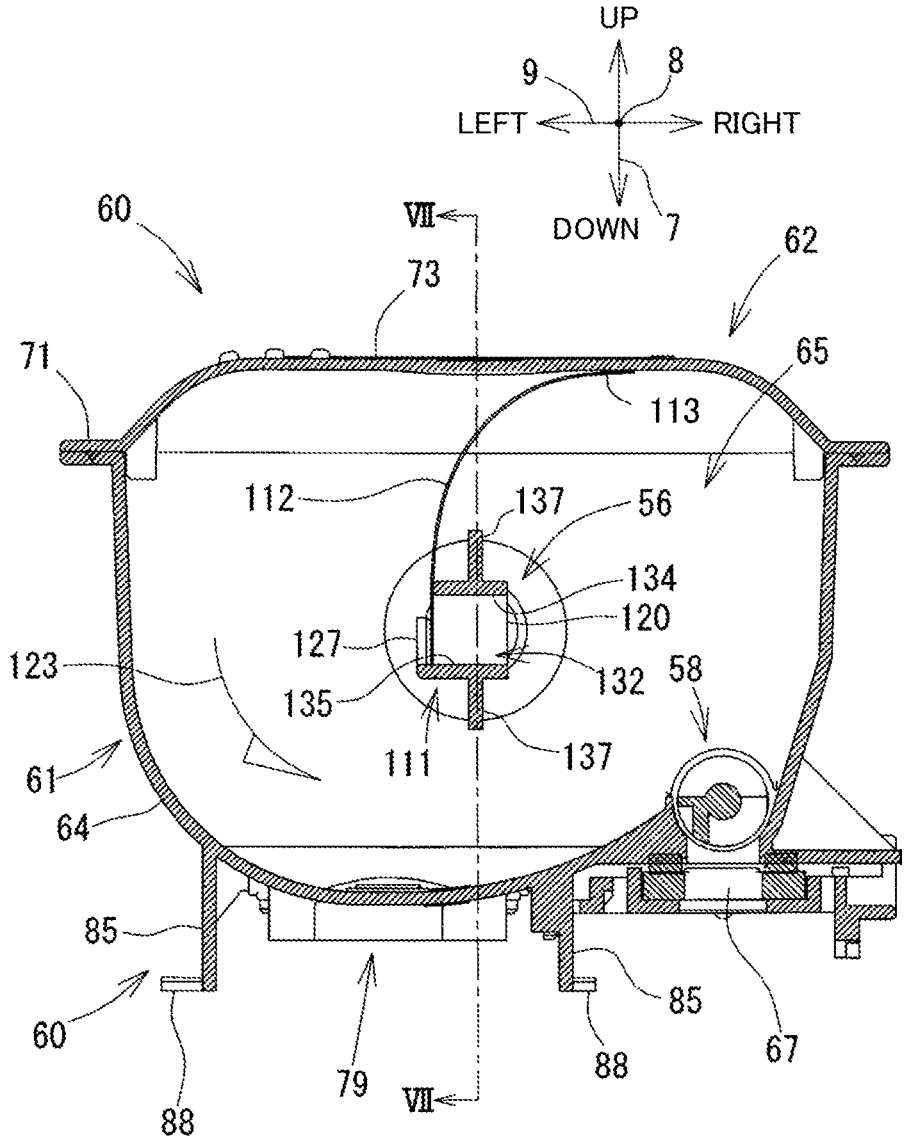
FIG. 6 is a cross-sectional view illustrating a cross-sectional structure of a plane taken along a line VI-VI in FIG. 4.

As shown in FIG. 6, the toner container 60 includes the agitating mechanism 56. The agitating mechanism 56 is disposed in the toner container 60. The agitating mechanism 56 operates to agitate toner stored in the toner container 60. The agitating mechanism 56 includes a rotation shaft member 111 and an agitating member 112.

Figure 8:
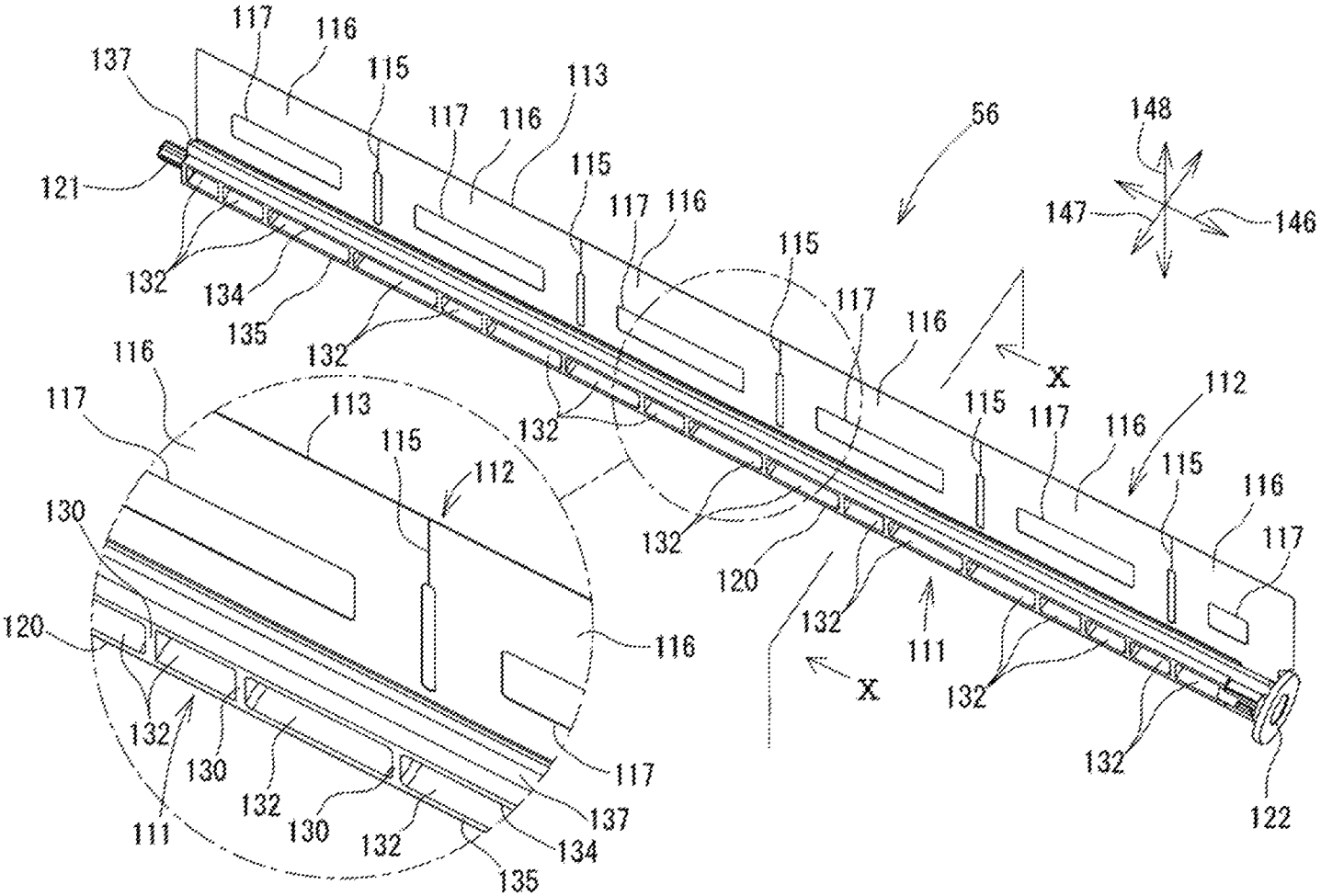
FIG. 8 is a perspective view illustrating a structure of an agitating mechanism according to an embodiment of the present disclosure.
Figure 9:
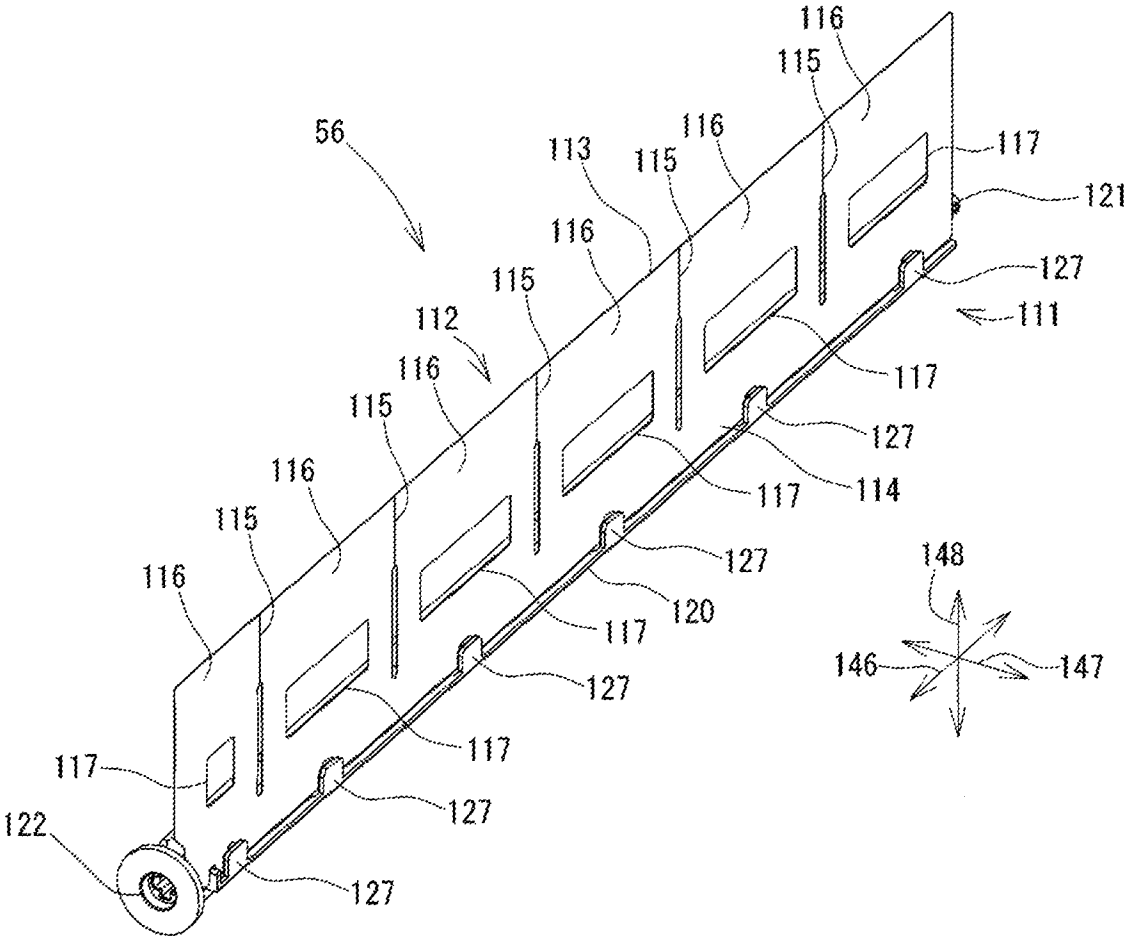
FIG. 9 is a perspective view illustrating a structure of the agitating mechanism shown in FIG. 8

The agitating member 112 is formed, by an elastic material such as a PET (polyethylene terephthalate) resin, into a film-like shape having a reduced thickness. Needless to say, the agitating member 112 may be formed by a synthetic resin, such as a polyvinyl chloride or a polycarbonate, other than a PET resin. As shown in FIGS. 8 and 9, the agitating member 112 is mounted to the rotation shaft member 111. In the present embodiment, the agitating member 112 is mounted over the entirety, in the longitudinal direction, of the rotation shaft member 111. The agitating member 112 is formed in a shape elongated along the longitudinal direction of the rotation shaft member 111. The agitating member 112 includes a plurality of cut portions 115 that are formed so as to extend from an edge portion 113 toward a mounting portion 114. Thus, movable pieces 116 adjacent to the cut portions 115 can be independently bent around the axis of the rotation shaft member 111. Each movable piece 116 has an opening 117 having an appropriate size in order to enhance agitating efficiency.

As shown in FIG. 6, in a state where the agitating member 112 is disposed in the toner container 60, the side surface of the edge portion 113 of the agitating member 112 comes into close contact with the inner surface of the toner container 60. Namely, the dimension of the agitating member 112 from the mounting portion 114 to the edge portion 113 is greater than the dimension from the rotation shaft member 111 to the inner surface of the toner container 60. Therefore, when the agitating member 112 is disposed in the toner container 60, the edge portion 113 is bent, whereby the side surface of the edge portion 113 comes into close contact with the inner surface of the toner container 60.

As shown in FIG. 7, the rotation shaft member 111 is disposed in the toner container 60 so as to be rotatable together with the agitating member 112. In FIG. 7, the agitating member 112 is not shown. The rotation shaft member 111 is a shaft member that is formed into a shape elongated in one direction. The rotation shaft member 111 is supported, by the container body 61, so as to be rotatable. In the present embodiment, both ends, in the longitudinal direction, of the rotation shaft member 111 are supported, by the external walls of the container body 61, so as to be rotatable. Specifically, the rotation shaft member 111 includes a shaft body 120. The shaft body 120 has a shape elongated in the axial direction of the rotation shaft member 111. The shaft body 120 has a support shaft 121 at one end thereof in the longitudinal direction. The support shaft 121 is supported, on a side surface 63 on one side in the longitudinal direction of the container body 61, so as to be rotatable. A shaft hole 122 is formed at the other end of the shaft body 120. The joint 57 is externally inserted into a through hole 124 of the rear surface 66, and a shaft portion 57A of the joint 57 is inserted into the shaft hole 122. Thus, the other end of the shaft body 120 is supported, by the rear surface 66, so as to be rotatable. Thus, the rotation shaft member 111 is supported, in the toner container 60, by the support shaft 121, the shaft hole 122, and the joint 57, so as to be rotatable.

Figure 10:
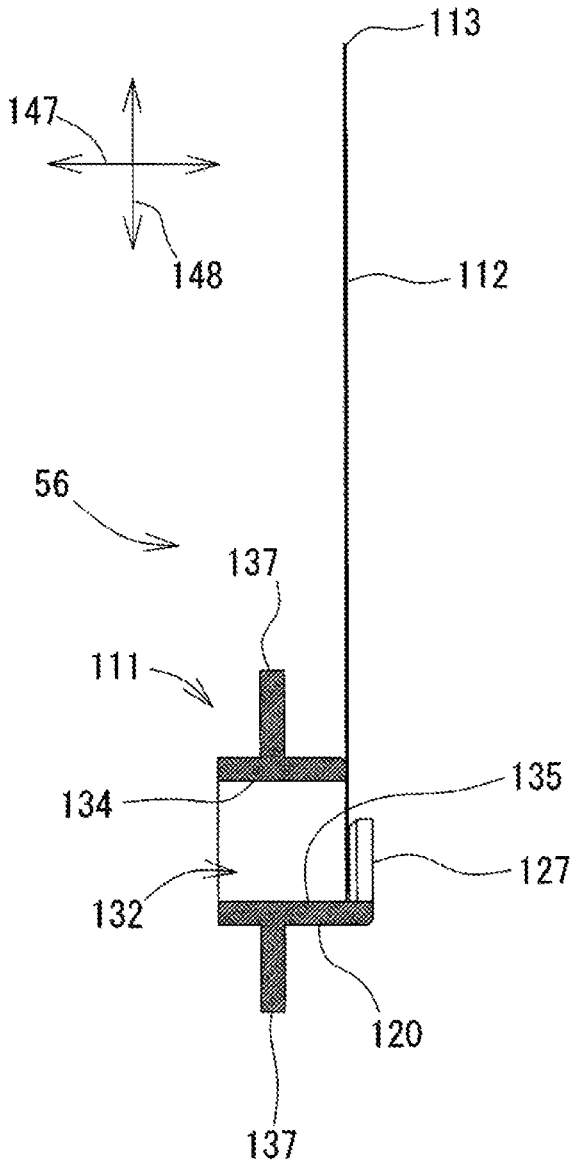
FIG. 10 is a cross-sectional view illustrating a cross-section of a plane taken along a line X-X in FIG. 8.

As shown in FIGS. 8 and 10, the shaft body 120 includes a plurality of through holes 132. The through holes 132 pass through the shaft body 120 in a direction 147 (hereinafter, referred to as a "first direction") orthogonal to a rotation axis direction 146 (direction corresponding to the longitudinal direction of the rotation shaft member 111) of the rotation shaft member 111. Namely, the rotation shaft member 111 has the through holes 132 that pass therethrough in the first direction 147. In the present embodiment, all the through holes 132 pass through the shaft body 120 in the same direction.

As shown in FIG. 8, the through holes 132 are separated by separation walls 130 in the rotation axis direction 146. Namely, the separation wall 130 is disposed between the through holes 132 adjacent to each other in the rotation axis direction 146. The separation walls 130 extend in the same direction as the direction in which the through holes 132 pass through the shaft body 120, that is, extend in the first direction 147.

As shown in FIGS. 8 and 10, the shaft body 120 includes two plate-shaped outer walls 134 and 135 that extend in the rotation axis direction. The outer walls 134 and 135 are orthogonal to the separation walls 130. The outer walls 134 and 135 are spaced from each other in a direction 148 (hereinafter, referred to as a "second direction") orthogonal to the rotation axis direction 146 and the first direction 147, and are disposed parallel to the rotation axis direction 146. Namely, the outer walls 134 and 135 are a pair of plate-shaped members spaced from each other in the second direction 148. The through holes 132 are defined by the outer walls 134 and 135 and the separation walls 130.

As shown in FIGS. 9 and 10, the shaft body 120 includes support portions 127. The support portions 127 are used for supporting the mounting portion 114 of the agitating member 112. The support portions 127 are disposed on the outer wall 135 that is one outer wall among the outer walls 134 and 135. Specifically, the support portions 127 are disposed in one end portion, in the first direction 147, of the outer wall 135. The support portions 127 are projecting pieces that project from the end portion of the outer wall 135 toward the other outer wall, that is, the outer wall 134. A plurality of the support portions 127 are provided so as to be spaced from each other in the rotation axis direction 146. The support portions 127 are disposed at positions corresponding to the movable pieces 116, respectively, of the agitating member 112. In the present embodiment, the support portions 127 are provided such that the number of the support portions 127 is the same as the number of the movable pieces 116. To the support portions 127, the mounting portion 114 of the agitating member 112 is joined. As a method by which the mounting portion 114 is jointed, for example, engagement of the mounting portion 114 with claw members (not shown) provided in the support portions 127, or adhesion of the support portions 127 and the mounting portion 114 to each other, is considered.

The outer walls 134 and 135 each includes a projecting member 137. In other words, the projecting member 137 is disposed on each of the paired outer walls 134 and 135. The projecting member 137 is a plate-shaped member that projects in the second direction 148 orthogonal to the rotation axis direction 146 and the first direction 147. The projecting member 137 projects from an outer side surface of each of the outer walls 134 and 135 in the direction (the direction corresponding to the second direction 148) perpendicular to the outer side surface. The projecting member 137 extends on each of the outer walls 134 and 135 along the rotation axis direction 146. Specifically, the projecting member 137 is disposed at the center, in the first direction 147, of each of the outer walls 134 and 135, and extends, in the rotation axis direction 146, over the entirety, in the longitudinal direction, of the shaft body 120. In the present embodiment, the projecting member 137 is formed so as to be integrated with the shaft body 120 through injection molding using a mold as described below. Therefore, the projecting member 137 functions as a reinforcing rib that enhances strength of the shaft body 120. The projecting member 137 is preferably disposed on each of the outer walls 134 and 135. However, the projecting member 137 may be disposed on one of the outer walls 134 and 135.

The rotation shaft member 111 is a synthetic resin product that is produced by melted synthetic resin being poured into a mold and subjected to injection molding. As the synthetic resin, an ABS resin, a PET (polyethylene terephthalate) resin, or a synthetic resin including an ABS resin and/or a PET resin as a main component, is used. In the present embodiment, the rotation shaft member 111 is formed by a thermoplastic PET resin being subjected to injection molding with the use of a mold having a draft angle in the first direction 147 which is the same as the direction in which the through holes 132 pass through the rotation shaft member 111. Since the rotation shaft member 111 has the through holes 132 formed in the first direction 147, the direction represented by the draft angle of the mold is made the same as the direction (the first direction 147) in which the through holes 132 pass through the rotation shaft member 111. Thus, the rotation shaft member 111 can be easily formed through injection molding with the use of the mold. Further, since the melted synthetic resin flows in the first direction 147 only, an efficiency with which the mold is filled with the synthetic resin is enhanced, and a time period in which the mold becomes filled with the synthetic resin can be shortened. Thus, forming efficiency is enhanced.

Since the agitating mechanism 56 is structured as described above, when the toner container 60 including the agitating mechanism 56 is mounted to the container mounting portion 40, the joint 53 of the drive transmission portion 42 is connected to the joint 57. Thus, rotation driving force of the motor (not shown) is transmitted through the joint 53 and the joint 57 to the rotation shaft member 111. When the rotation shaft member 111 rotates due to the rotation driving force, the agitating member 112 rotates about the axis of the rotation shaft member 111, according to the rotation of the rotation shaft member 111, in the same direction as the rotation direction of the rotation shaft member 111. In the present embodiment, the rotation shaft member 111 and the agitating member 112 rotate counterclockwise (in the direction indicated by an arrow 123) in FIG. 6. Thus, the agitating member 112 rotates due to the rotation of the rotation shaft member 111, whereby toner in the toner container 60 is appropriately agitated. The toner which is thus agitated is conveyed by the spiral shaft 58 (see FIG. 6) to the supply opening 67, whereby toner having uniform quality is supplied to the developing device 33.

Further, the rotation shaft member 111 has the through holes 132, and the through holes 132 have no bottom surfaces although a groove has a bottom surface in the conventional arts. Even when toner enters the through hole 132, toner is easily discharged on the opposite side of the through hole 132. Thus, toner is not accumulated in the through holes 132, and, needless to say, toner is not agglomerated into lumps of toner in the through holes 132. Therefore, the agitating mechanism 56 allows toner in the toner container 60 to be uniformly agitated without unevenness.

Further, the projecting member 137 is disposed on each of the outer walls 134 and 135 of the shaft body 120. Therefore, the rotation shaft member 111 has an enhanced strength in the rotation axis direction 146 due to the projecting members 137. Thus, reduction in strength due to the plurality of the through holes 132 being formed can be compensated by the projecting members 137.

Figure 11A:
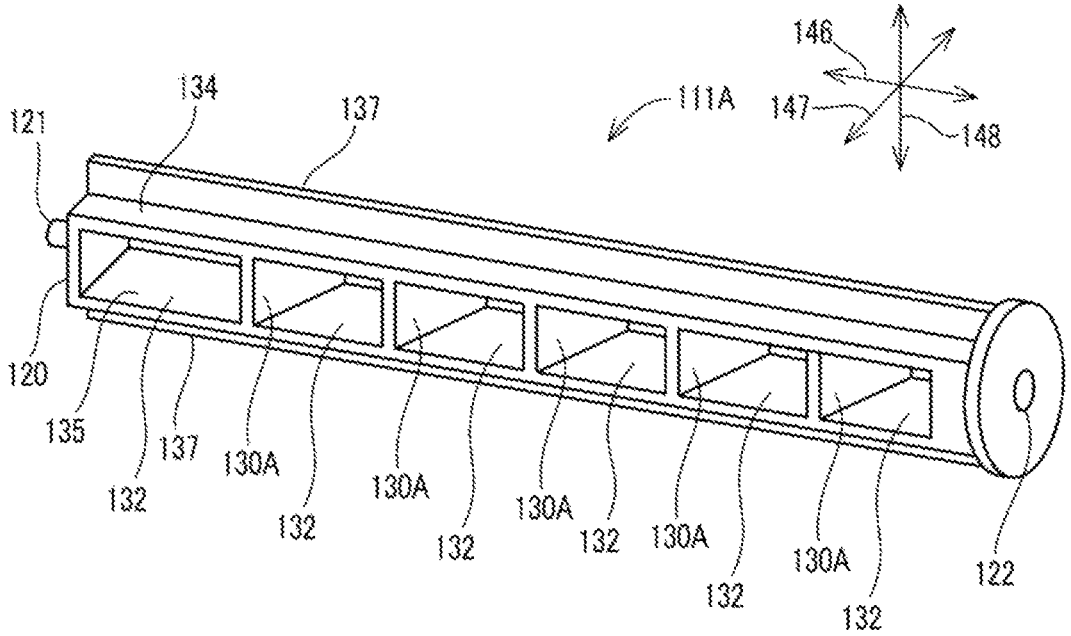
FIGS. 11A and 11B illustrate an exemplary modification of the agitating mechanism shown in FIG. 8.
Figure 11B:
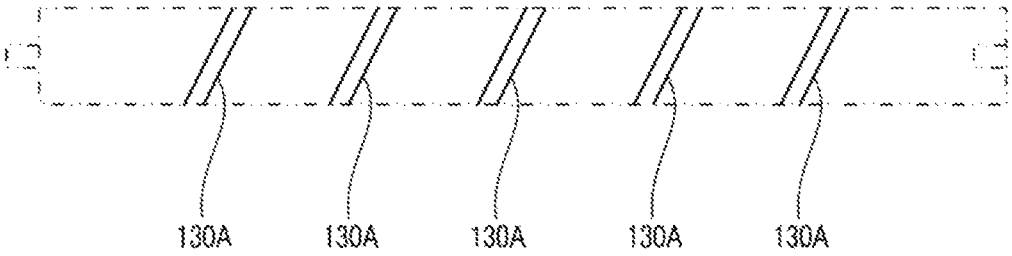

In the above embodiment, the rotation shaft member 111 having the separation walls 130 that extend in the first direction 147, is illustrated. However, the present disclosure is not limited thereto. For example, as shown in FIGS. 11A and 11B, a rotation shaft member 111A having separation walls 130A by which the through holes 132 adjacent to each other are separated, may be used. FIG. 11A is a perspective view illustrating a structure of the rotation shaft member 111A. FIG. 11B illustrates positioning of the separation walls 130A in the rotation shaft member 111A as viewed from above the outer wall 134. In the rotation shaft member 111A, the separation walls 130A each have an inclined surface that inclines relative to the first direction 147. In the rotation shaft member 111A having such a structure, when the rotation shaft member 111A rotates, a force by which toner is moved in the rotation axis direction 146 by the inclined surfaces of the separation walls 130A is applied to the toner. Thus, toner that has entered the through hole 132 can be easily discharged. Further, since toner is moved in the rotation axis direction 146, toner is agitated in the rotation axis direction 146 in addition to toner being agitated around the rotation shaft. In this case, the inclined surfaces of the separation walls 130A may be curved. Also by the separation walls 130A having such a structure, toner can be easily discharged from the through holes 132.

Figure 12A:
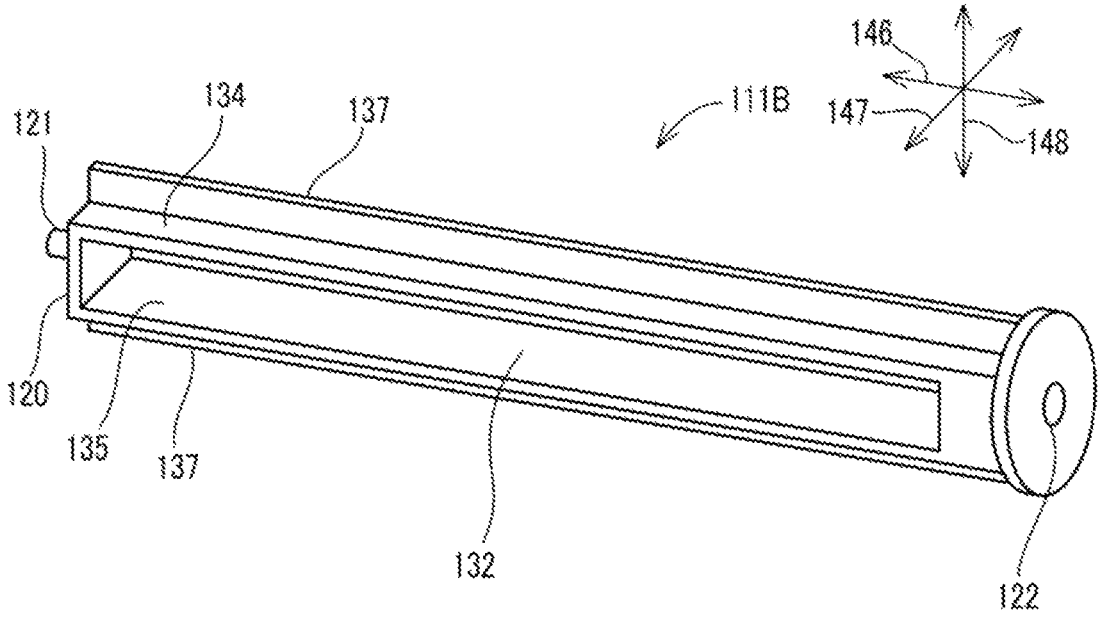
FIGS. 12A and 12B illustrate other exemplary modifications of the agitating mechanism shown in FIG. 8.

Further, in the above embodiment, the rotation shaft member 111 having the plurality of the through holes 132 is illustrated. However, the present disclosure is not limited thereto. For example, as shown in FIG. 12A, a rotation shaft member 111B having one through hole 132 formed along the longitudinal direction of the shaft body 120 may be used.

Figure 12B:
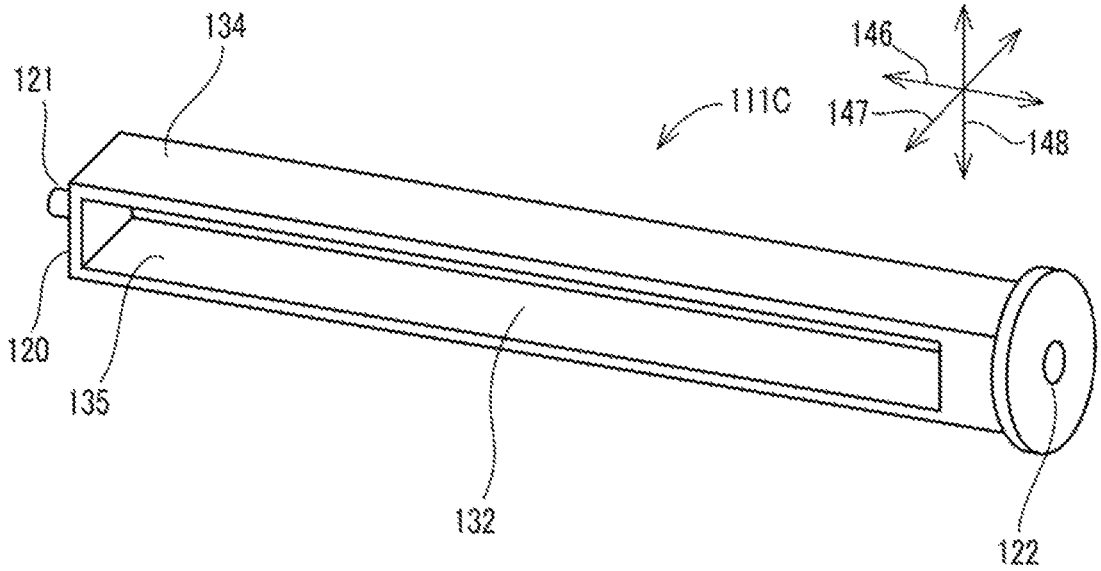

Further, in the above embodiment, the rotation shaft member 111 having the projecting members 137 formed in the shaft body 120 is illustrated. However, the present disclosure is not limited thereto. For example, as shown in FIG. 12B, a rotation shaft member 111C in which the projecting member 137 is not provided, and one through hole 132 is formed, may be used.

Figure 13:
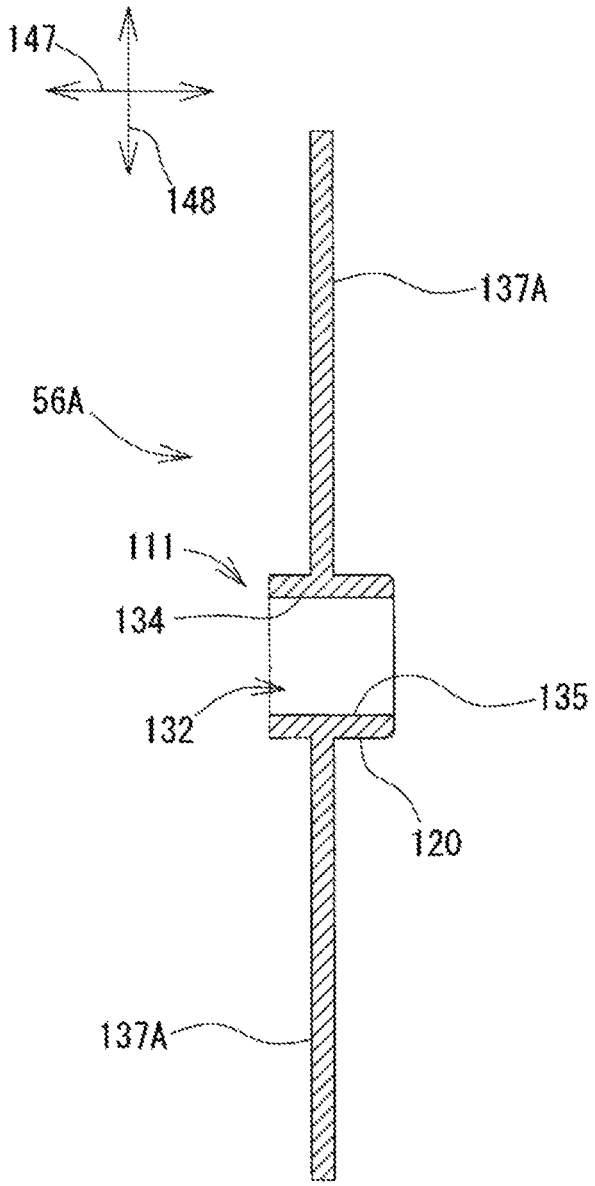
FIG. 13 illustrates a structure of an agitating mechanism according to another embodiment of the present disclosure.

Further, instead of the agitating mechanism 56 according to the above embodiment, an agitating mechanism 56A shown in FIG. 13 may be used. The agitating mechanism 56A includes a rotation shaft member 111 in which the agitating member 112 is not provided, and projecting members 137A having shapes elongated in the second direction are provided. Since the projecting members 137A each have an elongated shape, the projecting members 137A, instead of the agitating member 112, agitate toner. Namely, the projecting members 137A act as the agitating member 112. The projecting members 137A extend to the inner surface of the inner wall of the toner container 60. Thus, toner in the toner container 60 is uniformly agitated.

Figure 14:
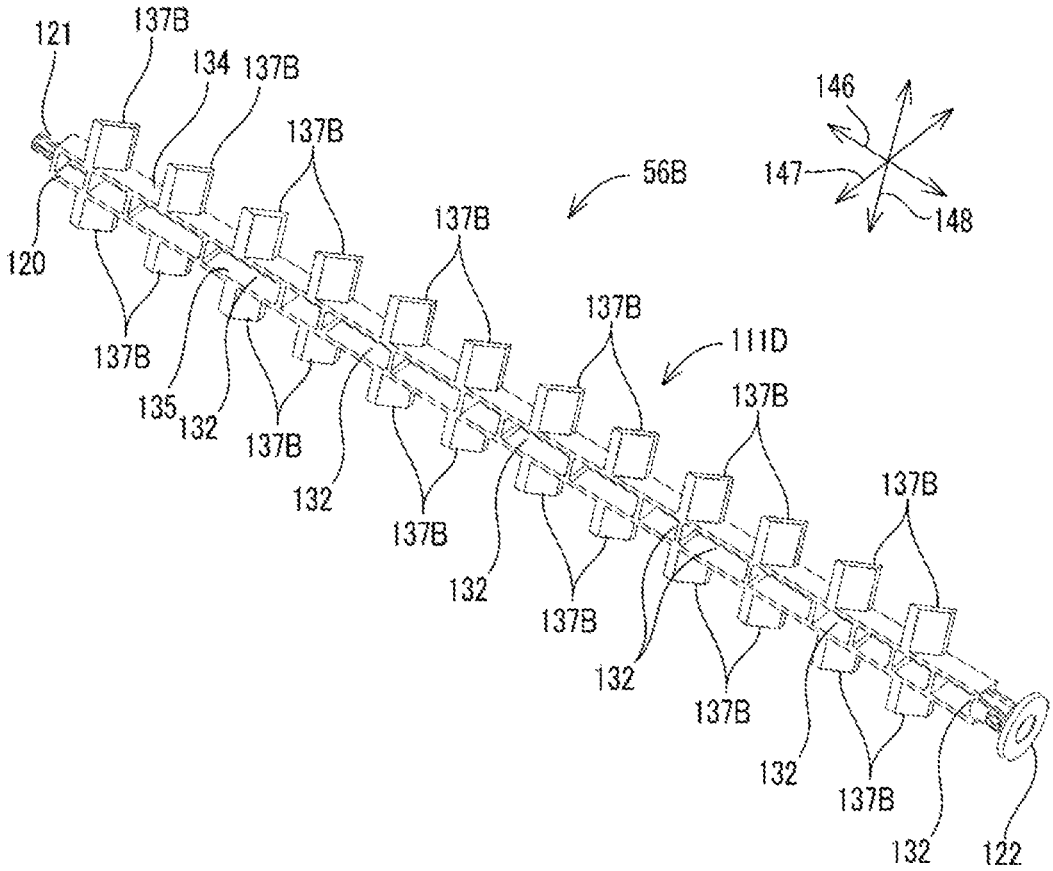
FIG. 14 illustrates a structure of an agitating mechanism according to another embodiment of the present disclosure.

Further, instead of the agitating mechanism 56 according to the above embodiment, an agitating mechanism 56B shown in FIG. 14 may be used. The agitating mechanism 56B has a rotation shaft member 111D in which the agitating member 112 is not provided, and a plurality of projecting members 137B are provided. In the rotation shaft member 111D, the plurality of projecting members 137B are disposed on each of the outer walls 134 and 135 of the shaft body 120 so as to be equally spaced from each other in the rotation axis direction 146. Further, the plurality of projecting members 137B incline in the same direction by a predetermined angle relative to the rotation axis direction 146. When the agitating mechanism 56B including the rotation shaft member 111D having such a structure is used, toner is uniformly agitated by the projecting members 137B, and further toner is conveyed in one direction by the plurality of projecting members 137B. Further, the projecting members 137B of the rotation shaft member 111D can double as the agitating member 112 and the spiral shaft 58. Namely, the agitating mechanism 56B in which the agitating member 112 and the spiral shaft 58 are not provided, can be obtained. The predetermined angle is set as an appropriate angle according to a speed at which toner is conveyed. The projecting members 137B are each set so as to have an appropriate size according to the size of the toner container 60 or toner agitating performance.

In the above embodiment, the toner container 60 including the agitating mechanism 56, 56A, or 56B, and the image forming apparatus 10 including the toner container 60 are described. However, the present disclosure may be implemented independently as the agitating mechanism 56, 56A, or 56B.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An agitating mechanism disposed in a toner container in which toner is stored, the agitating mechanism comprising:
- an agitating member configured to agitate the toner; and
- a rotation shaft member configured to support an agitating member that agitates the toner, the rotation shaft member provided, together with the agitating member, in the toner container so as to be rotatable, wherein
- the rotation shaft member includes:
  - a pair of outer walls that extend in a rotation axis direction;
  - a plurality of through holes that are defined by the pair of outer walls and pass through the rotation shaft member in a direction orthogonal to the rotation axis direction;
  - a projection member having a plate-like shape and projecting outward from at least one of the pair of outer walls, the projecting member extending in the rotation axis direction; and
- a plurality of separation walls that are disposed parallel to each other between the pair of outer walls in such a way as to separate the plurality of through holes along the rotation axis direction, wherein
- the separation walls respectively have inclined surfaces that incline relative to the rotation axis direction, and
- when the rotation shaft member rotates, the inclined surfaces respectively apply forces to toner that has entered the plurality of through holes such that the toner is moved in the rotation axis direction.

2. The agitating mechanism according to claim 1, wherein the separation wall is curved.

3. The agitating mechanism according to claim 1, wherein the projecting member extends to an inner wall of the toner container.

4. The agitating mechanism according to claim 1, wherein a plurality of the projecting members are provided so as to be spaced from each other in the rotation axis direction, and each of the projecting members inclines relative to the rotation axis direction.

5. The agitating mechanism according to claim 1, wherein the projecting member is disposed on each of the pair of outer walls.

6. The agitating mechanism according to claim 1, wherein the rotation shaft member consists of a thermoplastic synthetic resin having been subjected to injection molding using a mold having a draft angle in a direction orthogonal to the rotation axis direction.

7. A toner container, comprising:
- a container body in which toner is stored; and
- an agitating mechanism disposed in the container body, wherein
- the agitating mechanism includes a rotation shaft member that is configured to support an agitating member which agitates the toner, that is provided, together with the agitating member, in the container body so as to be rotatable, and
- the rotation shaft member includes:
  - a pair of outer walls that extend in a rotation axis direction;
  - a plurality of through holes that are defined by the pair of outer walls and pass through the rotation shaft member in a direction orthogonal to the rotation axis direction;
  - a projecting member having a plate-like shape and projecting outward from at least one of the pair of outer walls, the projecting member extending in the rotation axis direction; and
- a plurality of separation walls that are disposed parallel to each other between the pair of outer walls in such a way as to separate the plurality of through holes along the rotation axis direction, wherein
- the separation walls respectively have inclined surfaces that incline relative to the rotation axis direction, and
- when the rotation shaft member rotates, the inclined surfaces respectively apply forces to toner that has entered the plurality of through holes such that the toner is moved in the rotation axis direction.

8. The toner container according to claim 7, wherein the separation wall is curved.

9. The toner container according to claim 7, wherein the projecting member extends to an inner wall of the container body.

10. An image forming apparatus, comprising:
- a toner container having a container body in which toner is stored;
- an agitating mechanism disposed in the container body; and
- an image forming portion configured to form an image on a recording medium by using toner supplied from the toner container, wherein
- the agitating mechanism includes a rotation shaft member that is configured to support an agitating member which agitates the toner, that is provided, together with the agitating member, in the container body so as to be rotatable, and
- the rotation shaft member includes:
  - a pair of outer walls that extend in a rotation axis direction;
  - a plurality of through holes that are defined by the pair of outer walls and pass through the rotation shaft member in a direction orthogonal to the rotation axis direction;
  - a projecting member having a plate-like shape and projecting outward from at least one of the pair of outer walls, the projecting member extending in the rotation axis direction; and
  - a plurality of separation walls that are disposed parallel to each other between the pair of outer walls in such a way as to separate the plurality of through holes along the rotation axis direction, wherein the separation walls respectively have inclined surfaces that incline relative to the rotation axis direction, and when the rotation shaft member rotates, the inclined surfaces respectively apply forces to toner that has entered the plurality of through holes such that the toner is moved in the rotation axis direction.

11. The image forming apparatus according to claim 10, wherein the separation wall is curved.

* * * * *